United States Patent [19]

Baba et al.

[11] Patent Number: 4,605,448

[45] Date of Patent: Aug. 12, 1986

[54] ALUMINUM ALLOY FORMING SHEET AND METHOD FOR PRODUCING THE SAME

[75] Inventors: Yoshio Baba; Shin Tsuchida, both of Nagoya, Japan

[73] Assignee: Sumitomo Light Metal Industries, Ltd., Tokyo, Japan

[21] Appl. No.: 329,536

[22] Filed: Dec. 10, 1981

[30] Foreign Application Priority Data

Mar. 2, 1981 [JP] Japan ..... 56-028434

[51] Int. Cl.[4] ..... C22F 1/04

[52] U.S. Cl. ..... 148/11.5 A; 148/12.7 A; 148/415; 148/417; 148/439; 148/440

[58] Field of Search ..... 148/11.5 A, 12.7 A, 148/2, 415, 417, 439, 440

[56] References Cited

U.S. PATENT DOCUMENTS 4,282,044 8/1981 Robertson et al. ..... 148/11.5 A

*Primary Examiner*—R. Dean

*Attorney, Agent, or Firm*—Flynn, Thiel, Boutell & Tanis

[57] ABSTRACT

A high strength, aluminum alloy sheet having good formability is disclosed which is particularly suitable for forming can-body parts and can-end parts, which sheet has received a final cold rolling reduction of at least 50% and consists essentially of Mn 0.30 to 1.50 wt. %, Mg 0.50 to 2.00 wt. %, preferably 0.50 to 1.25 wt. %, Si 0.52 to 1.00 wt. % and the balance being Al and incidental impurities. If required, the aluminum alloy forming sheet may also, in addition to the above elements, contain at least one component selected from the group consisting of Fe, Cu, Cr, Zn and Ti in specified ranges. The alloy sheet was produced by a specially prescribed production method.

11 Claims, No Drawings

ALUMINUM ALLOY FORMING SHEET AND METHOD FOR PRODUCING THE SAME

BACKGROUND OF THE INVENTION

The present invention relates to an improved aluminum alloy forming sheet having a high strength and further to a method for producing the same.

In the field of can-making, forming materials having a strength and a formability at a satisfactory level have not been found to date, and so conventionally, in making a can or the like, for a beverage, food and other product, can body parts and can end parts have been respectively made of different materials according to the properties required for the respective parts.

Al-Mg alloys having a strength of nearly 40 kg/mm$^2$, such as 5082 aluminum alloy, 5182 aluminum alloy and 5056 aluminum alloy, have been used as can end materials or the like.

Further, heat-treatable aluminum alloys, such as Al-Cu type alloy, for example 2011, 2014, 2017 or 2024 alloys; Al-Mg-Si type alloy, for example, 6066 or 6262 alloy; and Al-Zn-Cu-Mg type alloy, for example, 7001, 7075 7079 or 7178 alloy are well-known as aluminum alloy materials having a strength exceeding 40 kg/mm$^2$.

However, the above aluminum base alloys are difficult to work from ingots into sheets and are poor in the forming property.

Further, alloy materials containing much Cu have a poor corrosion resistance. When the above heat-treatable aluminum alloys are subjected to heat treatments such as solution treatment or aging, conditions of these heat treatments must be carefully and strictly controlled.

Still further, these heat-treatable aluminum materials are poor in spinning and ironing properties, and similar properties required in can-making, and further, cracks, clouding and mottling occur during spinning or ironing operations and the surface appearance of the formed material is considerably impaired.

Generally, 3004 alloy has been used as a can body material, but the amount of reduction in thickness is limited to a low degree because of insufficient strength.

SUMMARY OF THE INVENTION

It is therefore an object of the present invention to provide an improved aluminum alloy forming sheet which has a higher strength than 5082 and 5182 aluminum alloys and a formability well comparable with 3004 aluminum alloys and a method for producing the same.

A further object of the present invention is to provide an aluminum alloy forming sheet suitable for use in the manufacture of can end parts and can body parts and capable of being worked to a sufficiently thin gauge without decreasing its properties below the level required for can materials.

In accordance with the present invention, it has been found the foregoing objects and advantages can be readily achieved by the aluminum alloy forming sheet which has received a final cold rolling reduction of at least 50% and which consists essentially of Mn 0.30 to 1.50 wt.%, Mg 0.50 to 2.00 wt.%, preferably 0.50 to 1.25 wt.%, Si 0.52 to 1.00 wt.% and the balance being aluminum and incidental impurities or the aluminum alloy forming sheet further containing at least one component selected from the group consisting of Fe up to 0.50 wt.%, Cu up to 0.50 wt.%, preferably 0.15 to 0.50 wt.%, most preferably 0.25 to 0.50 wt.%, Cr up to 0.50 wt.%, Zn up to 0.50 wt.% and Ti up to 0.05 wt.%. In the above alloy forming sheet, when the weight ratio of Mg content and Si content is in the range 1.0 to 2.0, a better effect can be achieved.

The aluminum alloy sheet having improved forming properties has been produced by the production method comprising the following steps:

(1) homogenizing the aluminum alloy cast ingot having the same composition as the above-mentioned forming sheet at a temperature of 570° C. or higher for a period of at least 3 hours;
(2) hot rolling the homogenized alloy;
(3) heating the hot-rolled alloy at a temperature of 540° C. or higher for not more than 10 minutes;
(4) rapidly cooling the heated alloy to a temperature of 100° C. or below and
(5) final cold rolling the cooled alloy to a rolling reduction of at least 50%.

Also, in the above procedures, modification or additional steps as described in the following preferred embodiment of the invention can be done.

The high strength alloy forming sheet with good formability in accordance with the present invention is particularly, but not exclusively, sutiable for use as can stock for beverages, foods and other goods.

Other and further objects of the present invention will become obvious from the following detailed description.

DETAILED DESCRIPTION OF THE PREFERRED EMBODIMENTS

As mentioned earlier briefly, the aluminum alloy forming sheet of the present invention has received a final cold rolling reduction of at least 50% and consists essentially of Mn 0.30 to 1.50 wt.%, Mg 0.50 to 2.00 wt.%, preferably 0.50 to 1.25 wt.%, Si 0.52 to 1.00 wt.% and the balance being aluminum and incidental impurities, and the alloy forming sheet may also contain further at least one component selected from the group consisting of Fe up to 0.50 wt.%, Cu up to 0.50 wt.%, preferably 0.15 to 0.50 wt.%, most preferably 0.25 to 0.50 wt.%, Cr up to 0.50 wt.%, Zn up to 0.50 wt.% and Ti up to 0.05 wt.%.

In the above-specified alloys, it is preferable that the weight ratio between Mg content and Si content is restricted within the range of 1.0 to 2.0.

In preparing the alloy forming sheet, in accordance with the present invention, the alloy having the same composition as the above described forming sheet is formed into a cast ingot in the conventional way and then subjected to a homogenizing treatment by heating at a temperature of at least 570° C. for 3 hours or longer.

After homogenizing, the alloy is hot rolled and then is subjected to an elevated temperature exposure at a temperature of at least 540° C. for a period of not more than 10 minutes. After the elevated temperature exposure, the alloy is rapidly cooled and receives a final cold rolling to effect a reduction in thickness of at least 50%.

In the above production process, cold rolling may also be conducted prior to the above heating at the temperature of at least 540° C. and further, prior to the final cold rolling, the alloy may be cold rolled to a reduction of 70% or less and, subsequently, thermally treated by heating at a temperature in the range of 120° to 150° C. for 1 to 5 hours.

The hot rolling is preferably conducted between the starting temperature of 460° to 550° C. and the finishing temperature of 300° or higher. Further heat treatment at a temperature of not more than 220° C. after the final cold rolling can provide a more highly improved forming sheet.

In practicing the present invention, the chemical composition limitation of the aluminum alloy forming sheet specified above must be closely followed in order to achieve the objects contemplated by the invention. The reason for the limitation of each ingredient of the alloy forming sheet is described below.

Mn mainly present as a hard compound $Al_6Mn$ is in the alloy and distributed throughout the alloy. The distribution of $Al_6Mn$ prevents fusion and adhesion of the alloy to tools and machines which occur during spining, ironing and similar operations required in can-making. When the amount of Mn is less than 0.30 wt.%, the above effect can be hardly obtained. On the other hand, Mn content exceeding 1.50 wt.% forms a giant compound, resulting a reduction of formability. Also, Mn serves to prevent a precipitation of $Mg_2Si$, and thus, when a high degree of strength is mainly intended, less Mn, within the above specified range, is better. However, when the prevention of fusion and adhesion is particularly contemplated, more Mn, of course within the above specified content range, is preferable.

Mg has an effect of improving strength in combination with Si. When the Mg content is less than 0.50 wt.%, a sufficient strength can not obtained. On the other hand, when Mg content exceeds 2.00 wt.%, the hot rolling property is reduced and further formability decreases because of excessive strength.

Si makes $Mg_2Si$ in combination with Mg and increases strength. However, when the Si content is less than 0.52 wt.%, not only special thermal-treatment conditions are required to ideally precipitate $Mg_2Si$ in the alloy, but also it is very difficult to obtain a high level of strength. On the other hand, when the Si amount exceeds 1.00 wt.%, excess Si remains after forming $Mg_2Si$. The excess Si increases the strength, but the formability decreases.

Furthermore, when the ratio of Mg and Si falls within the range of 1.0 to 2.0, an optimum strength can be achieved.

In addition to the above specified elements, the aluminum alloy forming sheet according to the present invention may also contain one or more elements of up to 0.50 wt.% Fe, up to 0.50 wt.% Cu, up to 0.50 wt.% Cr, up to 0.50 wt.% Zn and up to 0.05 wt.% Ti.

The homogenizing treatment is carried out to homogenize segregation of cast structure of the alminum alloy cast ingot having the above specified composition. In order to improve the formability, it is particularly desirable to spheroidize giant Mn compounds crystallized in the grain boundaries. The homogenizing is performed at a temperature of at least 570° C. When the homogenizing temperature is below 570° C., homogenizing proceeds very slowly and it takes very long time to achieve sufficient homogenization. For example, when homogenizing is performed by heating at a temperature of 580° C. for 8 hours, the spheroidizing reaches up to a degree of above 80%, which is desirable in practical use.

Hot rolling after the homogenizing treatment is preferably started at a temperature in a range of 460° to 550° C. and completed at a temperature of at least 300° C. When the starting temperature of hot rolling exceeds 550° C., cracks occur during the hot working operation. On the other hand, a starting temperature below 460° C. increases resistance to deformation and makes hot rolling operations difficult. Thus, the starting temperature in the range of 460° to 550° C. is desirable for anistropy of the alloy sheet and hot rolling property. Further, with regard to the finishing temperature, a finishing temperature less than 300° C. effects unfavorably the anisotropy and workability. However, when hot rolling is finished at a temperature of 300° C. or higher, in accordance with the present invention, an uniform recrystallized structure is achieved and giant grains do not form during subsequent heat treatment at a temperature of at least 540° C. A reduction amount of hot rolling is determined properly depending on the desired thickness of a final sheet product and the capacity of the device or machine used in heat treatments carried out after the hot rolling. Also, depending to the thickness of final product and machine capability, an intermediate cold rolling may be done after hot rolling.

The subsequent heat treatment at 540° C. or higher is conducted to dissolve Mg in the alloy structure. When the temperature for the heat treatment is less than 540° C., Mg can not dissolve sufficiently. The upper temperature limit of the above heat treatment is 600° C. because heating to a temperature exceeding 600° C. causes a local melting. Further, the heating time of the heat treatment is preferably 10 minutes or shorter. An excessive heating time of heat treatment is apt to cause an undesirable grain coarsening. When the heat treatment is followed by rapid cooling to a temperature 100° C. or below, the effect of the heat treatment can be sufficiently achieved. Cooling time is preferably 30 seconds or shorter.

After the rapid cooling, if needed, the heat-treated alloy is cold rolled to a reduction of not more than 70% and then heat treated at a temperature in range of 120° to 150° C. for a period of 1 to 5 hours. The cold rolling and the heat treating enhance precipitation of fine particles of $Mg_2Si$ along the dislocation line and increase the strength more highly.

Final cold rolling is carried out to obtain the desired strength. Although the reduction amount of the final rolling is adjusted according to use, the range of the reduction should be 50% or more because reduction less than 50% can not reach the desired level of 40 $kg/mm^2$.

In the present invention, if required, the final cold rolled alloy sheet is further thermally treated at a temperature not exceeding 220° C. for a short period. The additional thermal treatment increases the strength, and, at the same time, improves highly both the elongation property and the formability. When the forming process is carried out after applying a coating to the forming sheet, the additional heat treatment after final cold rolling can be substituted by a baking treatment of the coating, because the baking treatment is performed by heating at a temperature in range of 180° to 215° C. for a period between 10 and 20 minutes and such baking treatment is equvalent to the additional heat treatment. When the additional heat treatment is done at a temperature exceeding 220° C., the strength falls.

As mentioned above in detail, in accordance with the present invention, a high strength aluminum alloy sheet having a tensile strength exceeding 40 $kg/mm^2$ can be readily obtained and its formability and anisotropy are equivalent or superior to those of 5182-H39. Further, after spinning or ironing operations, any fusion or adhesion of the alloy forming sheet to the surface of tools and machines is not observed and the quality of the alloy forming sheet is equal or superior to that of 3004 alloy used in manufacturing DI cans. Still further, the strength is more highly increased by the baking treatment of the coating, and this advantage makes the aluminum alloy forming sheet of the present invention particularly, but not exclusively, suitable as materials of containers such as cans for beer or the like which receive forming, coating and baking operations. The high level of strength makes it possible to thin the thickness of the alloy forming sheet to a large extent without any significant lowering of properties. The strength of the alloy forming sheet is superior to that of conventional alloy 5182 well known as can-end stock and the formability is equal to that of conventional can-body stock. Thus, according to the present invention, both of the can end and the can body can be made of the same material.

Further, the aluminum alloy forming sheet of the present invention is highly excellent in corrosion resistance and undergoes an anodic oxidation treatment successfully. Thus, the alloy forming sheet according to the present invention can be also used in a applications in which conventional alloys such as 3004, 5052 and 5082 are used.

In the following, the aluminum alloy forming sheet and method of the present invention are described in more detail in comparison with reference aluminum alloy sheets, and the test results of these alloys are shown.

Cast ingots were produced by the conventional method using aluminum alloys having compositions shown in Table 1 and were used as starting materials.

TABLE 1

| No. | Chemical Composition (wt. %) | | | | | | | | |
|---|---|---|---|---|---|---|---|---|---|
| | Mn | Mg | Si | Fe | Cu | Cr | Zn | Ti | Al |
| Alloys of the Present Invention | | | | | | | | | |
| 1 | 0.70 | 1.03 | 0.57 | 0.32 | 0.20 | 0.20 | 0.01 | 0.04 | Bal. |
| 2 | 0.39 | 1.06 | 0.60 | 0.34 | 0.21 | 0.01 | 0.01 | 0.04 | Bal. |
| 3 | 0.98 | 1.09 | 0.58 | 0.33 | 0.21 | 0.01 | 0.01 | 0.04 | Bal. |
| 4 | 0.97 | 1.10 | 0.85 | 0.33 | 0.10 | 0.01 | 0.01 | 0.04 | Bal. |
| 5 | 0.60 | 1.25 | 0.57 | 0.34 | 0.45 | 0.01 | 0.01 | 0.03 | Bal. |
| Reference Alloy | | | | | | | | | |
| 6 | 0.95 | 1.03 | 0.37 | 0.34 | 0.21 | 0.00 | 0.01 | 0.03 | Bal. |

Then, the above cast ingots were subjected to treatments given in Table 2 to produce alloy forming sheets.

TABLE 2

| Procedures | Production Conditions | | | | |
|---|---|---|---|---|---|
| | A | B | C | D | E |
| Homogenizing | 580° C. × 12 hours | | | | |
| Hot Rolling | Starting Temperature: 540° C., Finishing Temperature: 312° C. (2.5 mmt) | | | | |
| Cold Rolling | — | — | — | — | 1.5 mmt |
| Heating | 550° C. × 3 minutes | | | | |
| Rapid Cooling | Rapid Cooling to a temperature of 100° C. or below for a period of 20 seconds | | | | |
| Cold Rolling | 2.5 mmt (0%) | 2.0 mmt (20%) | 1.0 mmt (60%) | — | — |
| Heat Treatment | 130° C. × 3 hours | | | — | — |
| Final Cold Rolling | 0.35 mmt (86%) | 0.35 mmt (83%) | 0.35 mmt (65%) | 0.35 mmt (86%) | 0.35 mmt (77%) |

In order to examine combinations of alloy compositions and production conditions, the following test were carried out on each of the alloy sheets produced under above each production conditions, using each of the alloy cast ingots. Test results are shown in Table 3. Values of each column are arranged in the order shown below.

| | | |
|---|---|---|
| Yield Strength $\sigma 0.2$: kg/mm$^2$ | Tensile Strength $\sigma B$: kg/mm$^2$ | Elongation $\delta$: % |
| Earing Ratio %: 45° −4 Directions | Erichsen Value EV: mm | Limit of Drawing Ratio LDR |

TABLE 3

| Production Conditions | Alloy | | | | | | | | | | | | | | | | | |
|---|---|---|---|---|---|---|---|---|---|---|---|---|---|---|---|---|---|---|
| | 1 | | | 2 | | | 3 | | | 4 | | | 5 | | | 6 | | |
| A | 41.2 | 42.2 | 4 | 43.7 | 44.7 | 4 | 40.9 | 41.9 | 3 | 41.0 | 41.9 | 4 | 43.4 | 44.2 | 3 | 32.9 | 33.5 | 3 |
| | 3.3 | 4.0 | 1.70 | 3.2 | 4.2 | 1.70 | 3.3 | 4.4 | 1.70 | 3.4 | 4.0 | 1.70 | 3.0 | 4.2 | 1.70 | 3.1 | 4.3 | 1.70 |
| B | 43.1 | 43.9 | 3 | 45.2 | 45.9 | 3 | 41.5 | 42.6 | 3 | 43.1 | 44.0 | 4 | 44.0 | 45.1 | 3 | 34.0 | 35.2 | 2 |
| | 3.5 | 4.2 | 1.70 | 3.1 | 4.2 | 1.70 | 3.0 | 4.4 | 1.70 | 3.2 | 4.2 | 1.70 | 3.0 | 4.2 | 1.70 | 3.0 | 4.1 | 1.70 |
| C | 42.8 | 43.8 | 3 | 44.2 | 46.1 | 3 | 41.8 | 43.0 | 3 | 43.0 | 43.7 | 4 | 43.8 | 45.6 | 3 | 34.5 | 35.5 | 2 |
| | 2.5 | 4.2 | 1.70 | 2.7 | 4.0 | 1.70 | 2.4 | 4.3 | 1.70 | 2.7 | 4.3 | 1.70 | 3.2 | 4.0 | 1.70 | 2.4 | 4.2 | 1.70 |
| D | 39.7 | 40.5 | 3 | 43.3 | 44.0 | 4 | 39.6 | 40.5 | 3 | 39.6 | 40.2 | 4 | 42.5 | 43.7 | 3 | 31.7 | 32.5 | 3 |
| | 3.5 | 4.3 | 1.70 | 3.5 | 4.1 | 1.70 | 3.3 | 4.4 | 1.70 | 3.1 | 4.2 | 1.70 | 3.0 | 4.2 | 1.70 | 3.4 | 4.3 | 1.70 |
| E | 38.0 | 39.5 | 3 | 40.8 | 42.4 | 4 | 38.6 | 38.9 | 3 | 38.4 | 39.5 | 4 | 41.7 | 42.0 | 3 | 31.0 | 31.7 | 3 |
| | 3.0 | 4.8 | >1.70 | 3.1 | 4.8 | >1.70 | 2.7 | 4.8 | >1.70 | 3.0 | 4.9 | >1.70 | 2.9 | 4.7 | >1.70 | 2.8 | 4.8 | >1.70 |

Further, each of the alloy sheets was heat-treated by heating at a temperature of 185° C. for 20 minutes and was tested in respect to the above tests.

Test results are indicated in Table 4.

TABLE 4

| Production Conditions | Alloy | | | | | | | | | | | | | | | | | |
|---|---|---|---|---|---|---|---|---|---|---|---|---|---|---|---|---|---|---|
| | 1 | | | 2 | | | 3 | | | 4 | | | 5 | | | 6 | | |
| A | 39.7 | 42.3 | 6 | 41.6 | 44.6 | 8 | 39.7 | 42.4 | 6 | 39.5 | 42.1 | 7 | 42.7 | 45.4 | 6 | 31.6 | 34.8 | 6 |

TABLE 4-continued

| Production Conditions | Alloy 1 | | | Alloy 2 | | | Alloy 3 | | | Alloy 4 | | | Alloy 5 | | | Alloy 6 | | |
|---|---|---|---|---|---|---|---|---|---|---|---|---|---|---|---|---|---|---|
| | 3.2 | 4.7 | 1.90 | 3.0 | 4.6 | 1.90 | 3.3 | 4.7 | 1.90 | 3.0 | 4.6 | 1.90 | 3.1 | 4.7 | 1.90 | 3.0 | 4.7 | 1.95 |
| B | 40.8 | 43.1 | 5 | 42.5 | 45.1 | 7 | 39.8 | 42.6 | 6 | 40.6 | 43.2 | 6 | 42.5 | 45.6 | 6 | 33.2 | 36.3 | 6 |
| | 3.3 | 4.7 | 1.90 | 3.0 | 4.3 | 1.90 | 3.0 | 4.6 | 1.90 | 3.1 | 4.8 | 1.90 | 3.0 | 4.6 | 1.90 | 3.0 | 4.6 | 1.90 |
| C | 41.1 | 43.2 | 6 | 42.9 | 45.0 | 7 | 39.4 | 42.4 | 6 | 41.4 | 43.4 | 7 | 42.2 | 45.9 | 6 | 33.5 | 36.4 | 6 |
| | 2.6 | 4.5 | 1.90 | 2.9 | 4.3 | 1.90 | 2.4 | 4.5 | 1.90 | 2.5 | 4.5 | 1.90 | 3.1 | 4.5 | 1.90 | 2.7 | 4.5 | 1.90 |
| D | 39.0 | 41.3 | 6 | 41.4 | 44.0 | 8 | 38.5 | 41.1 | 6 | 38.3 | 41.0 | 6 | 40.6 | 44.3 | 7 | 31.4 | 34.5 | 7 |
| | 3.1 | 4.7 | 1.90 | 3.3 | 4.6 | 1.90 | 3.1 | 4.4 | 1.90 | 3.0 | 4.8 | 1.90 | 3.0 | 4.5 | 1.90 | 3.5 | 4.8 | 2.05 |
| E | 37.1 | 40.2 | 6 | 40.1 | 43.3 | 8 | 37.2 | 40.2 | 7 | 36.5 | 40.1 | 7 | 40.0 | 43.1 | 7 | 29.7 | 33.4 | 6 |
| | 2.9 | 4.9 | 1.90 | 3.0 | 4.8 | 1.90 | 2.9 | 4.8 | 1.90 | 2.7 | 4.8 | 1.90 | 2.9 | 4.8 | 1.90 | 2.8 | 5.0 | 1.95 |

For further comparison, 5182 aluminum alloy which is considered to have the highest strength among the conventional forming materials and has been widely used was formed into a comparative sheet having a thickness of 0.35 mm in the conventional production procedures. The reduction amount of final cold rolling was 85%. The tests above mentioned were carried out on the comparative sheet after final cold rolling and test results are as follows:

Yield Strength 38–39 kg/mm$^2$; Tensile Strength 40–42 kg/mm$^2$; Elongation 5–6%; Earing Ratio (45°) 3.0–3.7%; Erichsen Value 4.2–4.6 mm; Limit of Drawing Ratio 1.7–1.8

The comparative sheet was further heat-treated at a temperature of 185° C. for 20 minutes after final cold rolling and was tested.

Test results was as follows:

Yield Strength 31–32 kg/mm$^2$; Tensile Strength 37–39 kg/mm$^2$; Elongation 7–9%; Earing Ratio (45°) 3.0–3.5%; Erichsen Value 4.5–4.8 mm; Limit of Drawing Ratio 1.90–1.95

As shown from the test results, the aluminum alloy sheet of the present invention has a strength highly superior to that of the conventional alloy sheet and is equivalent or superior to the conventional alloy in earing ratio, Erichsen value and limit of drawing ratio.

With regard to Table 4, when heat treatment was performed by heating at a temperature of 240° C. for a period of 10 minutes, not only does the strength decrease, but also the elongation is not much improved. Thus, such a heat-treating condition is not preferable in some uses.

Coating and baking operations done usually in can-making were conducted on the alloy sheets 0.35 mm thick of the present invention receiving the production steps of homogenizing to final cold rolling given in Table 2. The baking operation was done at a temperature of 205° C. for 10 minutes. After the baking, the alloy sheets were formed into a easy-open can end having the same size (2 2/16 inches diameter) as commonly practiced with 5182 alloy to examine the forming properties. As a result, rupture and poor forming did not occur during forming.

The alloy sheet produced under the production conditions E was subjected to deep drawing, re-drawing and ironing operations which are usually conducted on 3004 alloy and formed into a can body having a diameter of 2 2/16 inches and a height of 5 4/16 inches. In these operations, the fusion and adhesion of the alloy sheet to tools or devices was not observed, and the thus-formed can body had a very excellent appearance.

Further, the above forming operations were conducted on each of the alloy sheets produced under the production conditions A, B, C and D from the alloy cast ingots having compositions according to the present invention, adjusting appropriately conditions of ironing, and the same test results as the above were obtained.

What is claimed is:

1. A method for producing an aluminum alloy forming sheet suitable for use in manufacturing both can body parts and can ends, said method comprising the steps of:

(1) heating an aluminum alloy in the form of a cast ingot consisting essentially of 0.30 to 1.50 wt. % of Mn, 0.50 to 1.25 wt. % of Mg, 0.52 to 1.00 wt. % of Si and the balance being Al and incidental impurities at a temperature of at least 570° C. for a period of at least 3 hours to homogenize said aluminum alloy;

(2) then hot rolling the homogenized alloy;

(3) then heating the hot-rolled alloy at a temperature in the range of 540° C. to 600° C. for a period of not more than 10 minutes;

(4) then rapidly cooling the heated alloy to a temperature not exceeding 100° C.; and (5) final cold rolling the cooled alloy to a rolling reduction of at least 50% whereby to form said aluminum alloy forming sheet.

2. A method according to claim 1, wherein said aluminum alloy further contains at least one element selected from the group consisting of up to 0.50 wt.% Fe, up to 0.50 wt.% Cu, up to 0.50 Wt.% Cr, up to 0.50 wt.% Zn and up to 0.05 wt.% Ti.

3. A method according to claim 1, wherein the weight ratio of Mg to Si in said aluminum alloy is in the range of 1.0 to 2.0.

4. A method according to claim 1, comprising the further step of cold rolling the hot-rolled, homogenized alloy obtained in step (2) prior to said heating step (3).

5. A method according to claim 1, comprising the further steps of cold rolling said alloy obtained in step (4) to a reduction not exceeding 70%, and then heat treating said alloy at a temperature in a range of 120° to 150° C. for a period of 1 to 5 hours prior to said final cold rolling step (5).

6. A method according to claim 4, wherein said hot rolling step (2) is started at a temperature in the range of 460° to 550° C. and completed at a temperature of at least 300° C.

7. A method according to claim 1, wherein said final cold rolling step (5) is followed by a step of heating said sheet at a temperature of 220° C. or less.

8. A method as claimed in claim 1, further comprising, after said step (5), the steps of coating said sheet with a coating material, and then baking the coated sheet at a temperature in the range of 180° to 215° C. for 10 to 20 minutes.

9. A method for producing an aluminum alloy forming sheet suitable for use in manufacturing can body parts and can ends, comprising the steps of:

(1) heating an aluminum alloy in cast ingot form consisting essentially of 0.30 to 1.50 wt.% of Mn, 0.50 to 1.25 wt.% of Mg, 0.52 to 1.00 wt.% of Si and the balance being Al and incidental impurities, the weight ratio of Mg to Si being in the range of 1.0 to 2.0, at a temperature of at least 570° C. for a period of at least 3 hours to homogenize said aluminum alloy;

(2) then hot rolling said aluminum alloy starting at a temperature in the range of 460° to 550° C. and finishing at a temperature of at least 300° C.;

(3) then heating the hot-rolled alloy at a temperature in the range of 540° to 600° C. for a period of not more than 10 minutes;

(4) then cooling the heated alloy to a temperature of 100° C. or below over a cooling time of 30 seconds or less;

(5) then cold rolling said alloy to a reduction not greater than 70%;

(6) then heating said alloy to a temperature in the range of from 120° to 150° C. for a period of 1 to 5 hours;

(7) then final cold rolling said alloy to a reduction of at least 50% to form said aluminum alloy forming sheet.

10. A method as claimed in claim 9, further comprising the step of cold rolling the hot-rolled alloy after said step (2) and before said step (3).

11. A method for producing an aluminum alloy forming sheet suitable for use in manufacturing can body parts and can ends, comprising the steps of:

(1) heating an aluminum alloy in cast ingot form consisting essentially of 0.30 to 1.50 wt.% of Mn, 0.50 to 1.25 wt.% of Mg, 0.52 to 1.00 wt.% of Si and the balance being Al and incidental impurities, at a temperature of at least 570° C. for a period of at least 3 hours to homogenize said aluminum alloy;

(2) then hot rolling said aluminum alloy starting at a temperature in the range of 460° to 550° C. and finishing at a temperature of at least 300° C.;

(3) then cold rolling said hot-rolled alloy;

(4) then heating the cold-rolled alloy at a temperature in the range of 540° to 600° C. for a period of not more than 10 minutes;

(5) then cooling the heated alloy to a temperature of 100° C. or below over a cooling time of 30 seconds or less;

(6) then final cold rolling said alloy to a reduction of at least 50% to form said aluminum alloy forming sheet.

* * * * *